US007356126B2

(12) United States Patent
Bacher et al.

(10) Patent No.: US 7,356,126 B2
(45) Date of Patent: Apr. 8, 2008

(54) ANTISCATTERING GRIDS WITH MULTIPLE APERTURE DIMENSIONS

(75) Inventors: Guillaume Bacher, Palaiseau (FR); Rémy Klausz, Neuilly sur Seine (FR)

(73) Assignee: General Electric Company, Schenectady, NY (US)

( * ) Notice: Subject to any disclaimer, the term of this patent is extended or adjusted under 35 U.S.C. 154(b) by 92 days.

(21) Appl. No.: 11/183,377

(22) Filed: Jul. 18, 2005

(65) Prior Publication Data

US 2006/0098784 A1 May 11, 2006

(30) Foreign Application Priority Data

Nov. 5, 2004 (FR) ..... 04 11800

(51) Int. Cl.
*G21K 1/00* (2006.01)

(52) U.S. Cl. ..... 378/154; 378/149; 250/505.1

(58) Field of Classification Search ..... 378/154, 378/147–150; 250/363.1, 505.1
See application file for complete search history.

(56) References Cited

U.S. PATENT DOCUMENTS

| | | | | |
|---|---|---|---|---|
| 4,951,305 | A * | 8/1990 | Moore et al. | 378/147 |
| 4,969,176 | A * | 11/1990 | Marinus | 378/149 |
| 6,438,210 | B1 * | 8/2002 | Castleberry | 378/154 |
| 6,912,266 | B2 * | 6/2005 | Spahn | 378/98.8 |
| 6,968,041 | B2 * | 11/2005 | Hoheisel et al. | 378/154 |
| 2001/0050973 | A1 | 12/2001 | Ogawa | |
| 2002/0168052 | A1 | 11/2002 | Castleberry | |
| 2003/0123615 | A1 | 7/2003 | Klausz | |
| 2004/0131158 | A1 | 7/2004 | Hoheisel et al. | |

* cited by examiner

*Primary Examiner*—Jurie Yun
(74) *Attorney, Agent, or Firm*—Cantor Colburn LLP

(57) ABSTRACT

An antiscattering grid for a radiation imaging apparatus is disclosed. The antiscattering grid having a plurality of strips substantially absorbing X-rays and separated from each other by inter-strip spaces substantially transparent to the X-rays. The dimensions of apertures separating two successive strips among the plurality of strips is not constant.

26 Claims, 6 Drawing Sheets

ANTISCATTERING GRIDS WITH MULTIPLE APERTURE DIMENSIONS

CROSS-REFERENCE TO RELATED APPLICATIONS

This application claims the benefit of a priority under 35 USC 119(a)-(d) to French Patent Application No. 04 11800 filed Nov. 5, 2004, the entire contents of which are hereby incorporated by reference.

BACKGROUND OF THE INVENTION

An embodiment of the invention relates to antiscattering grids used in X-ray imaging. As illustrated in FIG. 1, a radiology imaging apparatus conventionally comprise means for providing a source of radiation 1, such as an X-ray source, and means for detecting emitted radiation 2, such as an image receiver 2. The object 3 for which an image is to be produced is located between the source and the receiver. A beam emitted by the source 1 passes through the object before reaching the detector 2. The beam is partly absorbed by the internal structure of the object 3 such that the intensity of the beam received by the detector is attenuated. The global attenuation of the beam after passing through the object 3 is directly related to the distribution of absorption in the object 3.

The image receiver 2 comprises an opto-electronic detector or a reinforcing film/screen pair sensitive to the radiation intensity. Consequently, the image generated by the receiver corresponds (in principle) to the distribution of global attenuations of rays, due to passing through internal structures in the object.

Part of the radiation 4 emitted by the source 1 is absorbed by the internal structure of the object 3, and the remainder is either transmitted or scattered. In the remainder, the transmitted radiation 5 is referred to as "primary radiation" (or direct radiation) and the scattered radiation 6 is referred to as "secondary radiation". The presence of secondary radiation 6 degrades the contrast of the image obtained and reduces the signal/noise ratio. This is particularly of concern when it is required to display details of the object 3.

A solution to this problem comprises inserting an "antiscattering" grid 7 between the object 3 to be X-rayed and the image receiver 2. This grid is positioned in a plane parallel to the plane comprising the image receiver 2. The plane of the grid will be called the grid positioning plane in the remainder of this document.

As illustrated in FIG. 1, an antiscattering grid 7 comprises a periodic arrangement of parallel plates 8 with height h maintained within the inter-plate members 9. The plates 8 are composed of a dense material strongly absorbent of X-rays, and the inter-plate members 9 are filled with a material more transparent to X-rays. The plates 8 are at a constant pitch or period. This pitch corresponds to the spacing 10 measured center-to-center (the center of a plate corresponding to its center of symmetry) between two plates 8, or the spacing 11 measured edge-to-edge between two plates 8. The concept of aperture "O" is also defined, corresponding to the distance 12 between faces facing of two successive plates 8, in other words the width of inter-plate members 9. The antiscattering grids 7 considerably improved the contrast of the images obtained. These grids 7 allow primary radiation 5 to pass through, and absorb secondary radiation 6.

An antiscattering grid is characterised particularly by three parameters, namely a primary radiation transmission ratio Tp, a secondary radiation transmission ratio Ts and application limits. The primary radiation transmission ratio Tp is related to the fact that primary rays 5 are attenuated by the plates 8 due to the non-zero width of these plates 8 and absorption of the inter-plate members. The secondary radiation transmission ratio Ts is related to the fact that some secondary rays pass through the grid at the inter-plate members 9. The application limits define a range of distances from the source at which the grid can be placed while maintaining an acceptable attenuation level on the edges (for example as defined in standard IEC 60627).

In order to obtain a good quality grid, it will be necessary to: maximize the primary radiation transmission ratio Tp that contains useful information; minimize the secondary radiation transmission ratio Ts that reduces the image contrast; and maximize application limits that define the range of grid/source distances at which the grid can be placed. The secondary radiation transmission Ts depends on a ratio R called the "grid ratio". This grid ratio R is equal to the quotient of the plate height h divided by the aperture O:

$$R = \frac{h}{O}.$$

Prior art solutions to improve the quality of antiscattering grids are based particularly on minimizing transmission of secondary radiation Ts. One solution comprises increasing the grid ratio R by increasing the height h of the plates 8 while maintaining the same aperture O. However, this solution has the following disadvantages: transmission of primary rays becomes more sensitive to alignment defects of plates 8 with the X-ray source (as the grid ratio increases, the transmission of primary rays becomes more sensitive to defocusing of plates with respect to the source); application limits are smaller; the primary radiation transmission ratio Tp is reduced; the increase in the height h of the plates 8 induces an increase in the height of the inter-plate members; and consequently, the length of the imperfectly transparent material that the X-rays have to pass through is greater, inducing greater attenuation of X-rays.

Another solution comprises reducing the aperture O while keeping the same height h for the plates 8. However, this solution has the following disadvantages: transmission of primary rays becomes more sensitive to alignment defects of plates 8 with the X-ray source; application limits are smaller; and the primary radiation transmission ratio Tp is reduced; the reduction in the aperture for the same plate width induces an increase in the relative surface area occupied by the edges of the plates, and therefore a greater attenuation of X-rays. Thus, even if the increase in the grid ratio R can help to improve elimination of secondary radiation, it also degrades transmission of the primary radiation. This attenuation of the primary radiation causes an increase in the X-ray dose emitted to the patient to obtain a useable image, which is not desirable.

BRIEF DESCRIPTION OF THE INVENTION

An embodiment of the invention is directed to an antiscatter grid to overcome at least one of the disadvantages of known antiscattering grids. In particular, an embodiment of the invention is an antiscatter grid that maximizes the primary radiation transmission ratio Tp, or minimizes the secondary radiation transmission ratio Ts, or maximizes application limits, wherever possible. An embodiment of the invention is related to a new type of antiscattering grid.

An embodiment of the invention is antiscattering grid comprising a plurality of strips absorbing radiation distributed on the grid and extending transversely within the thickness of the grid, these strips being separated from each other by inter-strip members practically transparent to the radiation, the grid being such that the distance separating two successive strips among the plurality of strips is not constant.

In the embodiments of the invention, "the distance separating two successive strips" refers to the distance between points facing the ends of the strips absorbing the radiation furthest from the radiation source (distal ends of strips absorbing radiation, with regard to the radiation source when the grid is in position in the imaging assembly).

An embodiment of the invention relates to a radiation imaging apparatus comprising means for providing a radiation source and means for receiving the emitted radiation, such as an image receiver, wherein the apparatus has an antiscattering grid according to an embodiment of the invention, the grid being located between the radiation source and the receiver.

An embodiment of the invention is directed to a method for manufacturing an antiscattering grid according to an embodiment of the invention comprising: forming grid elements, each grid element being composed of an assembly of a strip of material strongly absorbing radiation and an inter-strip member more transparent to radiation; superposing grid elements on top of each other; and fixing the elements thus superposed, the method being such that the width of inter-strip members forming the grid elements is not constant.

BRIEF DESCRIPTION OF THE DRAWINGS

Other characteristics of the embodiments of the invention will become clearer from the following description given purely for illustrative and non-limitative purposes, and should be read with reference to the attached drawings, in which.

DETAILED DESCRIPTION OF THE INVENTION

In general the following describes one or more non-limitative aspects of an embodiment of the invention for an antiscattering grid:

three successive strips among the plurality of strips define a pattern that is repeated, the first and second strips of the pattern being spaced of a first distance and the second and third strips of the pattern being spaced of a second distance;

five successive strips among the plurality of strips define a pattern that is repeated, three successive strips of the pattern being spaced of a first distance, the other pairs of successive strips in the pattern being spaced of a second distance;

the successive strips located in a central area of the grid are spaced of a first distance and the successive strips located in the peripheral areas of the grid are spaced of a second distance;

the strips among the plurality of strips are spaced of multiple distances;

the multiple distances are distributed by increasing distance from the center of the grid to the periphery of the grid;

the grid is a 1D grid;

the grid is a 2D grid;

the strips of the plurality of strips extend along a plurality of parallel planes; and the strips of g the plurality of strips extend in a plurality of planes, the planes of the plurality of planes intersecting along the same straight line.

Figure 1:
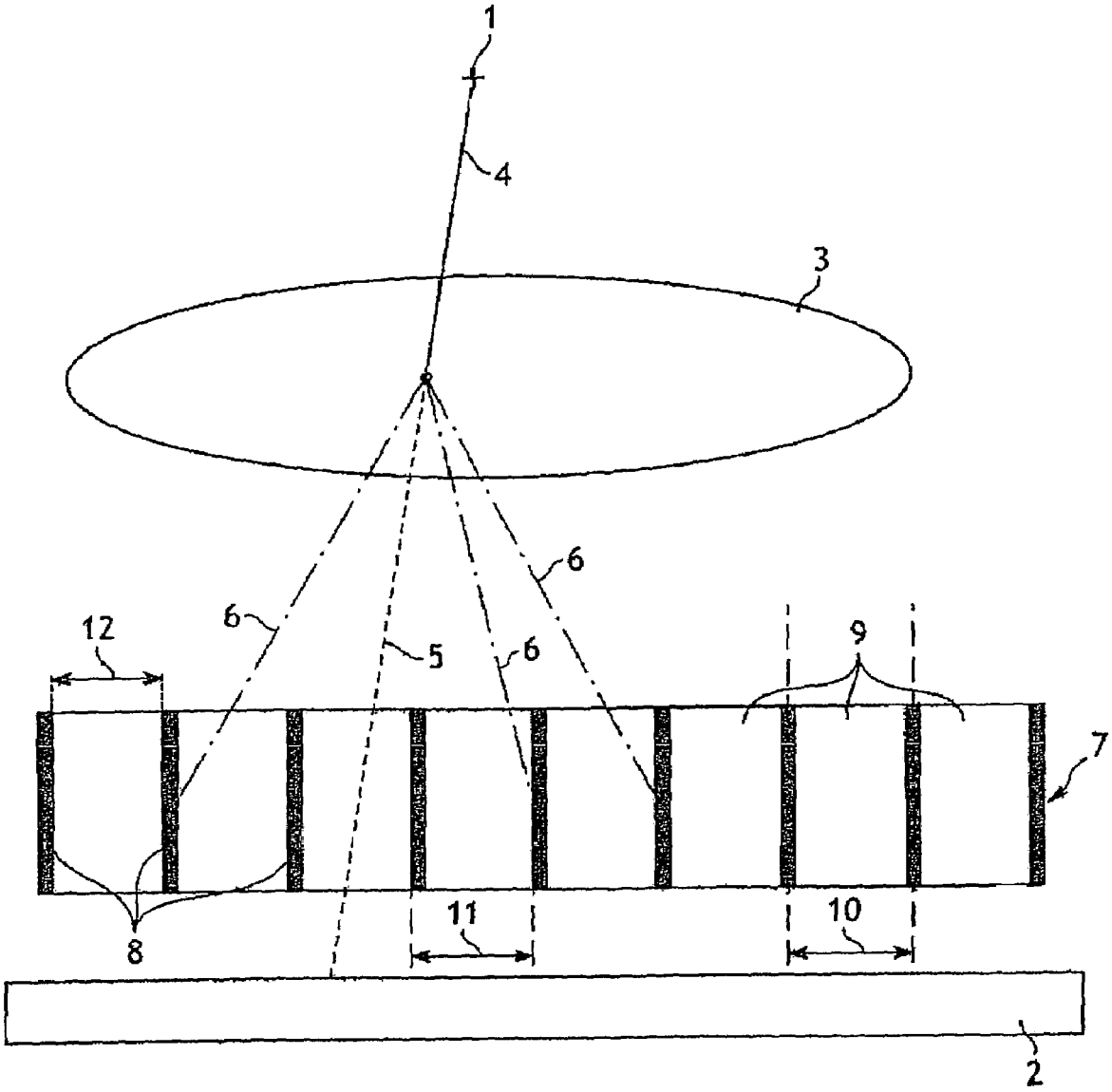
PRIOR ART FIG.1
FIG. 1 is a schematic view of a known radiological apparatus comprising a source, an antiscattering grid and a receiver.
Figure 2:
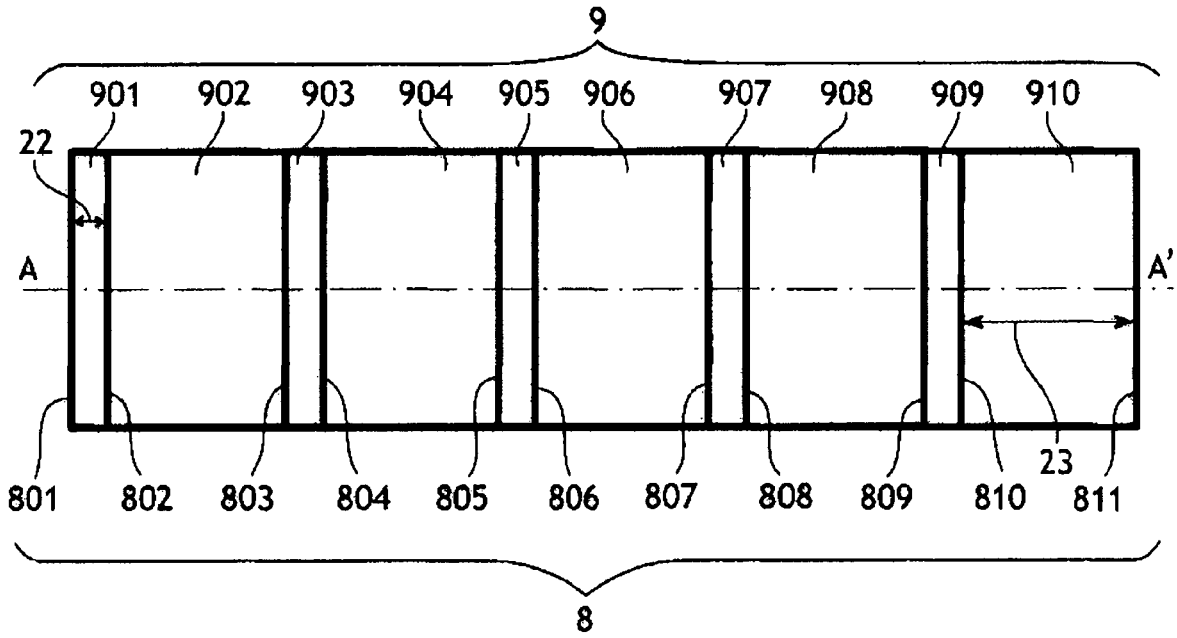
FIG. 2 is a cross-sectional view of an embodiment of the invention for an antiscattering grid.

FIG. 2 shows an embodiment of the invention for an antiscattering grid. This grid comprises a plurality of strips 8 separated from each other by substrate inter-strip members 9. The strips 8 are composed of a metal material that strongly absorbs X-rays. In general, the material used to make the metal strips 8 is a metal such as gold, copper, tantalum or lead, these materials possibly being used alone, in combination or in association with other materials. Preferably, the absorbing strips are made of copper or gold or gold-plated copper or lead-plated copper.

Substrate inter-strip members 9 are composed of a material that only slightly absorbs X-rays. In general, the material transparent to X-rays used to fill the inter-strip members is a polymer material. For example, the inter-strip members may be composed of polyethylene or polyimide resin (the polyimide is used to form flexible inter-strip members). They may also be composed of a material such as aluminium or cellulose fibers such as paper or wood.

As illustrated in FIG. 2, the width of substrate inter-strip members 9 in the grid is variable. The grid comprises substrate inter-strip members 901, 903, 905, 907, 909 with a first width 22 and substrate inter-strip members 902, 904, 906, 908, 910 with a second width 23. These substrate inter-strip members 9 with different widths are alternately inserted between metal strips 8, in other words a substrate inter-strip space 901 with the first width follows a substrate inter-strip member 902 with the second width, and then a substrate inter-strip member 903 with the first width and so on along the A-A' axis (crossing through at least three metal strips). It is understood that the magnitude of the substrate inter-strip member that is qualified as the "width" may be equal to the distance separating the faces facing of two successive metal strips, in the case of a grid with parallel metal strips.

Three successive strips 801, 802, 803 define a pattern M1 that is repeated along the A-A' axis, the first and second strips 801, 802 of the pattern M1 being spaced of a first distance 22 and the second and third strips 802, 803 of the pattern M1 being spaced of a second distance 23 greater than the first distance 22.

This embodiment of the invention for an antiscattering grid is a solution to minimize the rejection ratio of primary radiation while maximizing the rejection ratio of secondary radiation. The presence of metal strips on the grid spaced of first narrow distances 22 gives excellent rejection of secondary radiation Ts on part of the surface of the image receiver 2. The presence of metal strips on the grid spaced of second wider distances 23 (wider than the first distances) improves the grid positioning tolerance in the grid-positioning plane. It will appreciated that the presence in the grid, of metal strips spaced of different first and second distances does not induce an accumulated loss of primary radiation, since primary radiation losses overlap on an area 30 as illustrated in FIG. 3.

Figure 3:
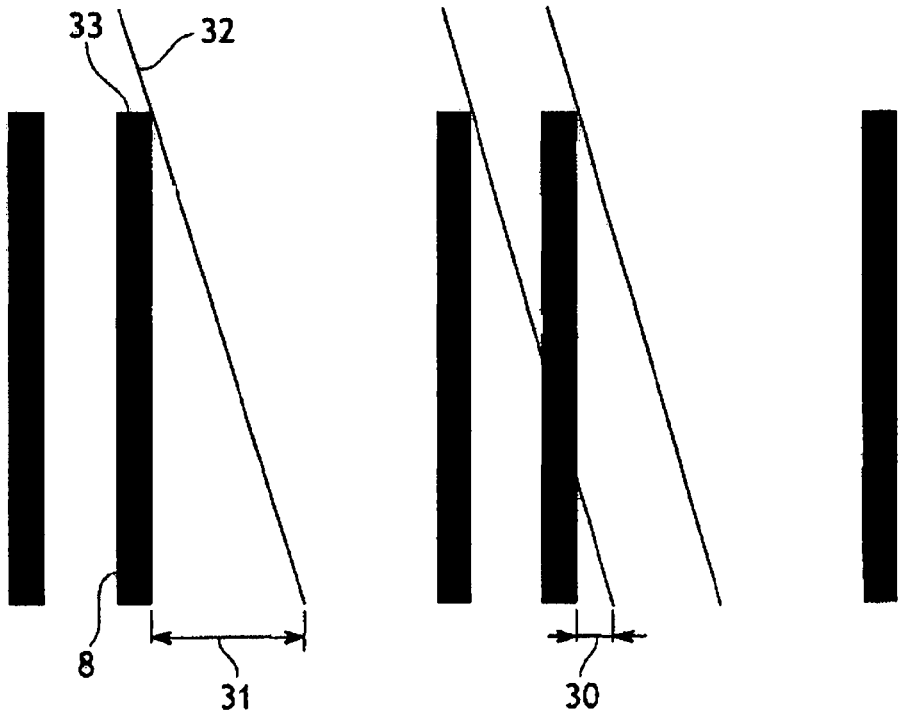
FIG. 3 is cross-sectional view of the embodiment of the invention for the antiscattering grid of FIG. 1.

In the technology for known an antiscattering grid, primary radiation losses (related to the primary radiation transmission ratio Tp) are calculated with respect to a magnitude called "wall cast shadow" 31 as illustrated in FIG. 3. This cast shadow 31 is defined by drawing a straight line 32 passing through the vertex 33 of a metal strip 8, this line 32 being at an angle with the normal to the plane of the grid. The value of this angle is given in standard IEC 60627 that deals with definition, determination and indication of the characteristics of antiscattering grids used in X-ray imagery diagnostic equipment.

Figure 4:
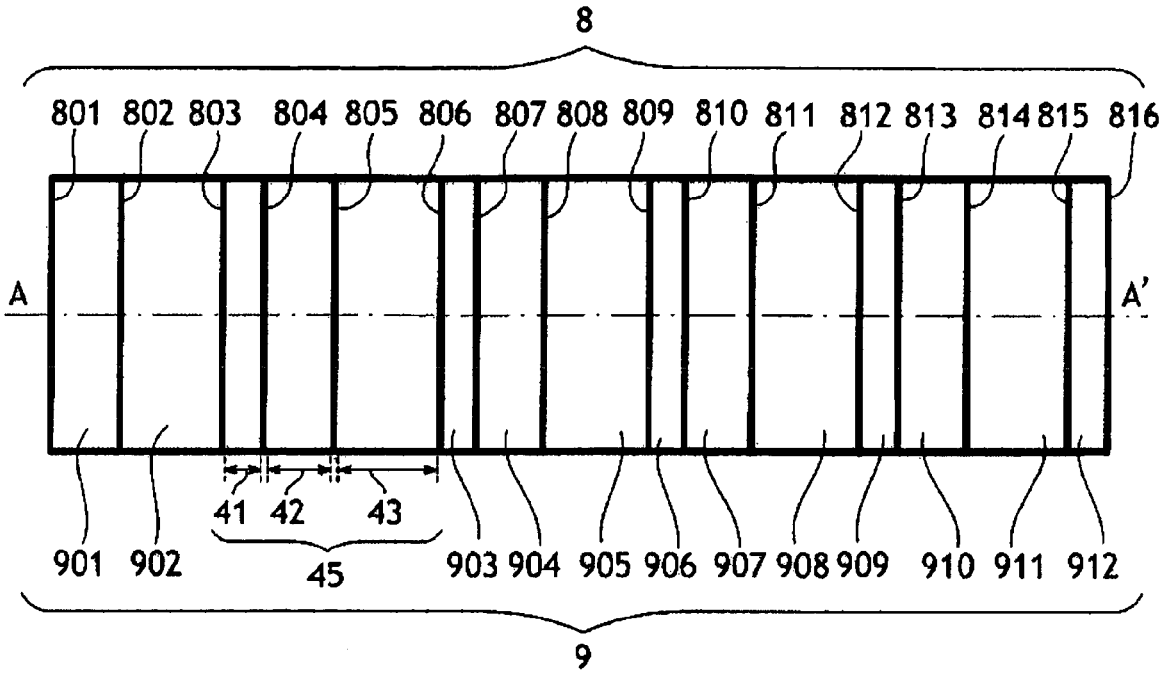
FIG. 4 is a cross-sectional view of another embodiment of the invention for an antiscattering grid.

FIG. 4 shows another embodiment of the invention for an antiscattering grid. In this embodiment, the grid comprises parallel metal strips 8 maintained between substrate inter-strip members 9. Distances between successive metal strips 8 along the A-A' axis vary according to first distances 41, second distances 42 and third distances 43 that are different. The proposed antiscattering grid may comprise apertures with multiple dimensions. For example, if there are N metal strips 8 in the antiscattering grid, the number of different distances between two successive strips may be between two and N-1. In FIG. 4, the number of different distances (or different dimensions of apertures) between two successive strips in the grid is equal to three.

In the embodiment of an antiscattering grid illustrated in FIG. 4, four successive strips 803, 804, 805, 806 define a pattern 45 that is repeated along the A-A' axis, two successive metal strips 803, 804 of the pattern 45 being spaced of a first distance 41, two successive metal strips 804, 805 of the pattern 45 being spaced of a second distance 42, and two successive metal strips 805, 806 of the pattern 45 being spaced of a third distance 43. The first, second and third distances are distributed alternately along the A-A' axis.

Figure 5:
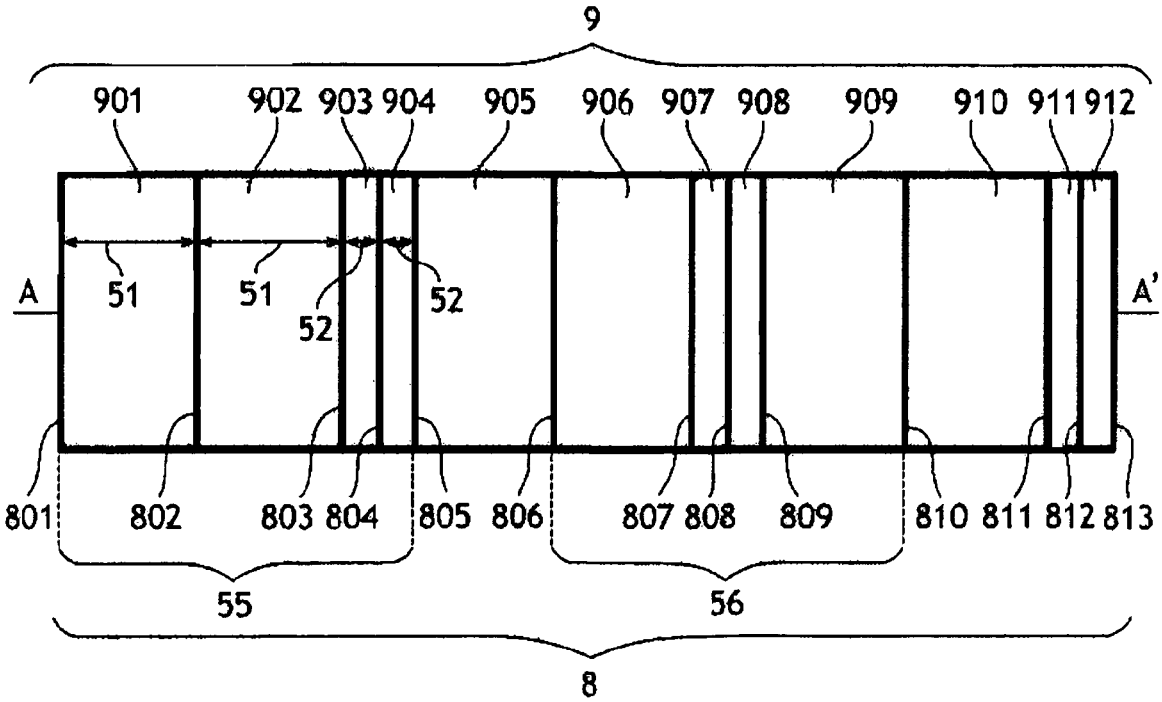
FIG. 5 is a cross-sectional view of another embodiment of the invention for an antiscattering grid.

Another embodiment of the invention for an antiscattering grid is illustrated in FIG. 5. In this embodiment, the metal strips 8 are spaced of a first distance 51 and a second distance 52 that are different. The first and second distances 51, 52 between successive metal strips are distributed such that five successive strips 801, 802, 803, 804, 805 (806, 807, 808, 809, 810 respectively) of the plurality of strips (8) define a pattern 55 (56 respectively) that is repeated along the A-A' axis, three successive strips 801, 802, 803 (807, 808, 809 respectively) of pattern 55 (pattern 56 respectively) being spaced of first distances 51 (second distances 52 respectively), the other pairs of successive strips 803, 804 and 804, 805 (806, 807 and 809, 810 respectively) of the pattern being spaced of second distances 52 (first distances 51 respectively).

In the embodiment of the invention for the antiscattering grid with parallel metal strips 8 illustrated in FIG. 5, the substrate inter-strip members 9 have two different widths, namely a first width 51 and a second width 52, the substrate inter-strip members 9 being distributed such that two substrate inter-strip members 903, 904 with the second width 52 follow two substrate inter-strip members 901, 902 with the first width 51, and that two substrate inter-strip members with the first width 905, 906 follow two substrate inter-strip members 903, 904 with the second width 52, and so on along the A-A' axis.

One skilled in the art will understand that the number of separate distances between two successive strips may be more than two (three, four, five, etc.).

Figure 6:
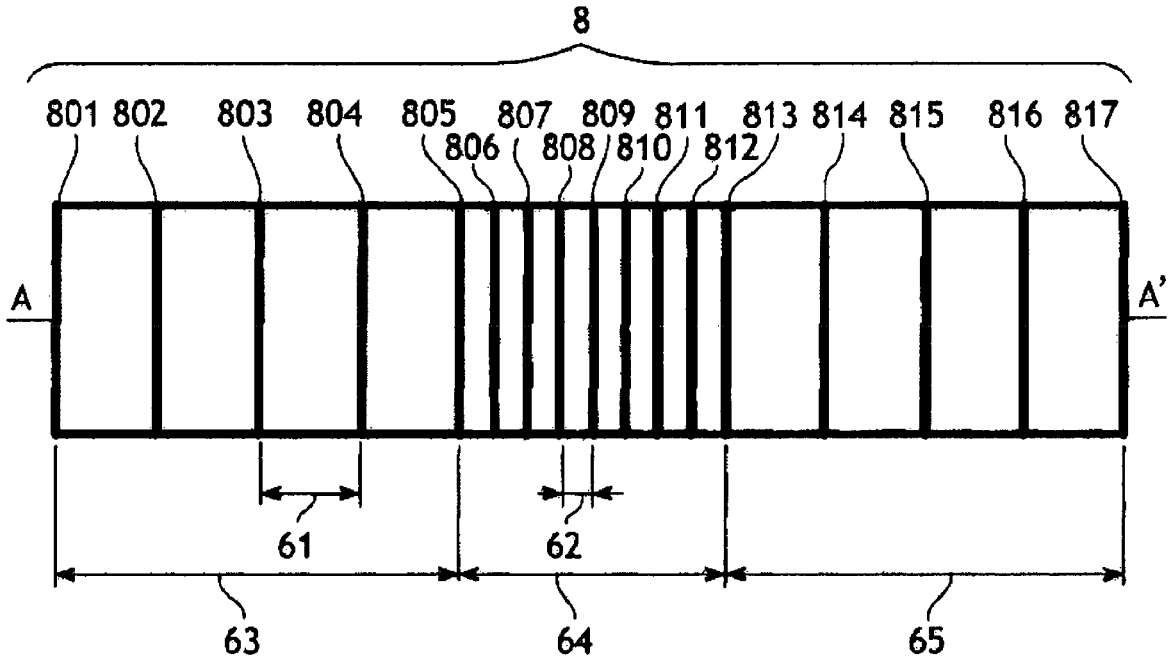
FIG. 6 is a cross-sectional view of another embodiment of the invention for an antiscattering grid.

Another embodiment of the invention for an antiscattering grid is illustrated in FIG. 6. In this embodiment, the antiscattering grid comprises strips spaced of first narrow distances 62 and successive strips spaced of second wider distances 61 along the A-A' axis. The first and second distances 61, 62 between successive metal strips are distributed by area 63, 64, 65. In the central area 64 of the antiscattering grid, two successive metal strips 805, 806 chosen from among the metal strips 805 to 813 are spaced of the first distance 62. In the peripheral areas 63, 65 of the antiscattering grid, two successive metal strips 801, 802 chosen from among the metal strips 801 to 805 and 813 to 817 are spaced of the second distance 61.

Figure 7:
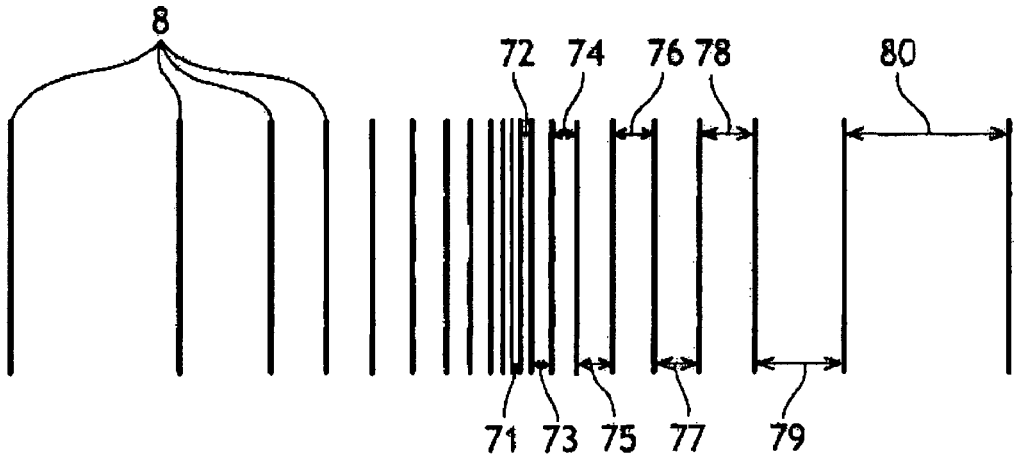
FIG. 7 is a cross-sectional view of another embodiment of the invention for an antiscattering grid.

FIG. 7 illustrates another embodiment of the invention for an antiscattering grid. In this embodiment, the metal inter-strip members maintained between substrate strips are in pairs spaced of multiple distances. The multiple distances 71, 72, 73, 74, 75, 76, 77, 78, 79, 80 are distributed in an increasing manner from the central metal strip of the antiscattering grid to the periphery of the grid.

The embodiments of invention for an antiscattering grids can be used to obtain good rejection of radiation diffused in the central area of the image receiver 2, where diffusion is the greatest, with a lesser consequence on transmission of primary radiation when the source/grid distance is changed.

Figure 8:
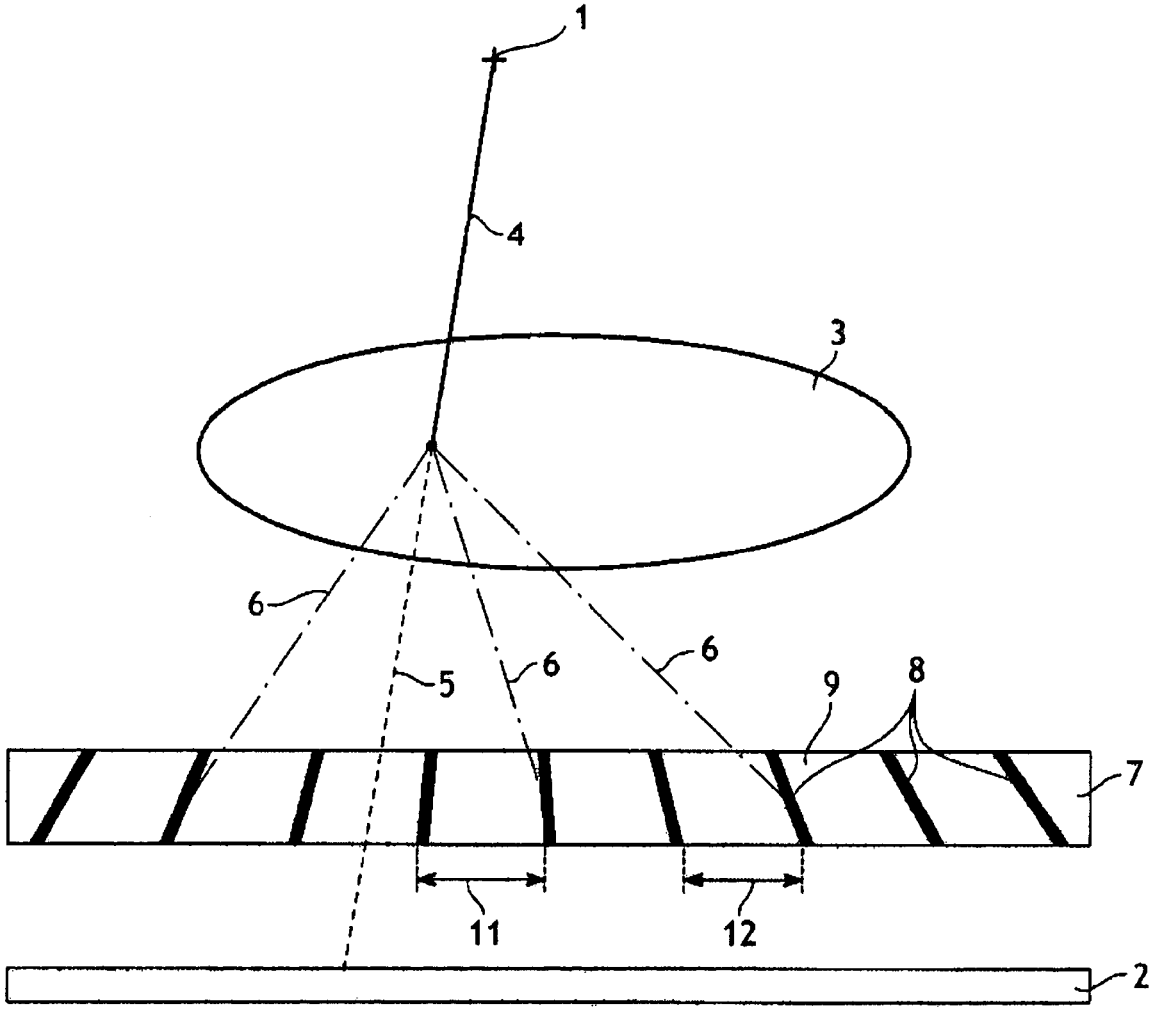
FIG. 8 is a diagram illustrating a radiological instrument comprising a source, a focused antiscattering grid and a receiver.

The different embodiments of the invention for an antiscattering grid are illustrated for a grid with parallel metal strips. However, the different proposed embodiments could also be used on a focused grid. As illustrated in FIG. 8, in so-called "focused" grids (using the terminology defined in standard IEC 60627 "X-radiation imagery diagnostic equipment—Characteristics of general purpose antiscattering grids and mammography"), all planes of the metal strips 8 intersect along a straight line passing through the focal point of radiation emitted by the source 1. In a focused antiscattering grid, the distance separating two successive strips will be understood as being the magnitude separating points facing the ends furthest from the source 1 (distal ends of metal strips from the source 1) from the faces facing of the two successive strips.

Figure 9:
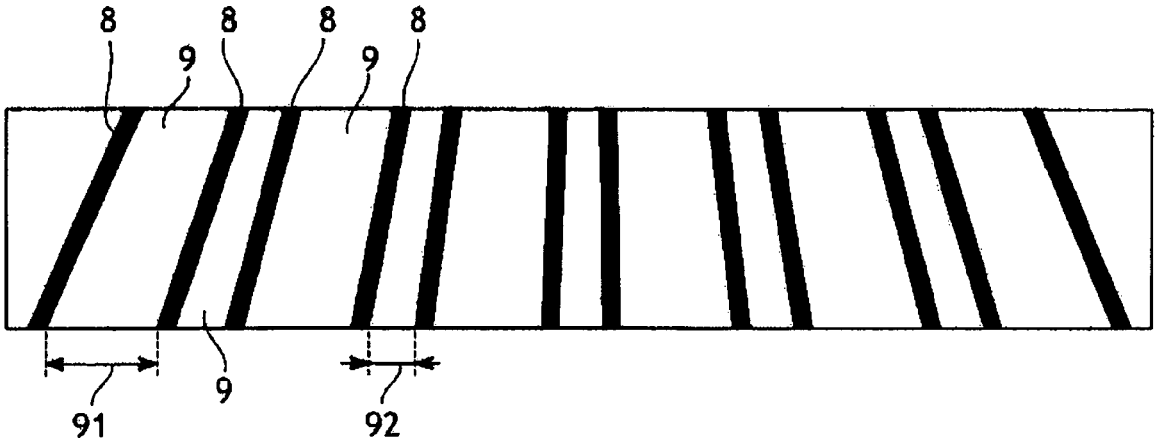
FIG. 9 is a cross-sectional view of a focused antiscattering grid according to an embodiment of the invention.

FIG. 9 shows an embodiment of the invention for a focused antiscattering grid. As described previously, this antiscattering grid comprises a plurality of metal strips 8 maintained on a substrate, these metal strips being distributed along the A-A' axis. The distance between successive metal strips of the plurality of metal strips 8 varies along the A-A' axis; this distance is not constant. The grid has first distances 91 and second distances 92 between successive strips. These first and second distances 91, 92 are distributed alternately along the A-A' axis.

Figure 10:
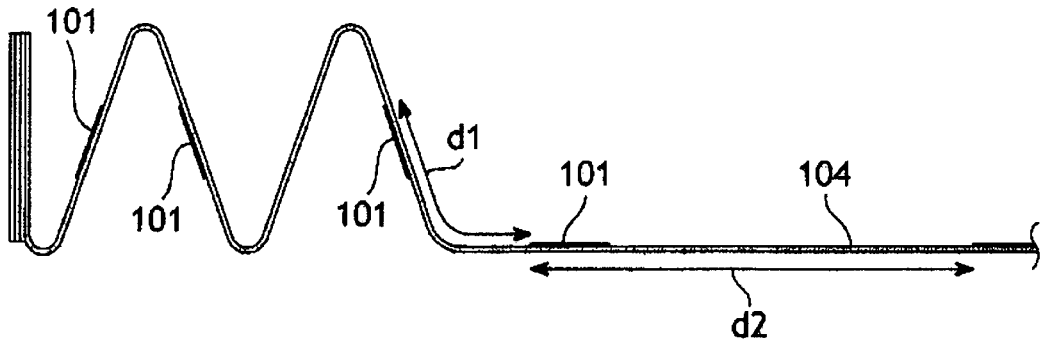
FIG. 10 is a diagram illustrating an embodiment of a method for manufacturing an embodiment of the invention for a antiscattering grid.

An embodiment of the invention for an antiscattering grid comprises a method for manufacturing the antiscattering grid as described with respect to FIG. 10. This method comprises: forming grid elements, in other words an assembly of a layer of material absorbing X-rays (the metal strip or plate) and a layer of material more transparent to X-rays (the substrate inter-strip member or inter-plate member); superposing grid elements on top of each other; and fixing the elements thus superposed. A characteristic of the embodiments comprises not forming grid elements with the same width. To manufacture the antiscattering grid according to the different embodiments, the width of the layer of material transparent to X-rays should vary (which varies directly with the distance separating two successive strips). The term "width" may be understood as being equal to the magnitude separating points facing the distal ends from the faces facing of two successive strips. For example, grid elements can be formed by using metal deposition techniques currently used for manufacturing printed circuits. These techniques generally comprise depositing a layer of metal by rolling on a polymer material substrate. The metal is chemically treated to obtain good metal/substrate bond. The metal layer is then covered by a photo-resist film or masking varnish. This film is exposed to UV radiation through a photography mask. The illuminated portions correspond to metal strips to be protected. These film portions are polymerised by light energy ("insolation" phase) that makes them bond better to the metal and gives them better resistance to etching agents. The film surface is then subjected to the action of a stripping agent. Non-polymerised portions of film and the corresponding metal layer are eliminated from the surface of the substrate.

An antiscattering grid according to one of the embodiments may be fabricated using a substrate 104 composed of a flexible material. A polyimide, for example Kapton®, is usually used as a substrate. Grid elements are formed by etching metal strips 101 on the two faces of the substrate 104, the metal strips 101 being positioned alternately on one face of the substrate and then on the other at varying distances. For example, in FIG. 10 showing a method of making antiscattering grids according to an embodiment, wherein the metal strips 101 are positioned alternately at a distance d1 and at a distance d2 from the previous metal strip 51. The substrate 104 is then folded "in accordion" between the etched metal strips 51 so as to obtain a stack of elements composed of strips of absorbing material and substrate inter-strip members filled with a material more transparent to X-rays. Excess portions of the substrate are then cut out.

Figure 11:
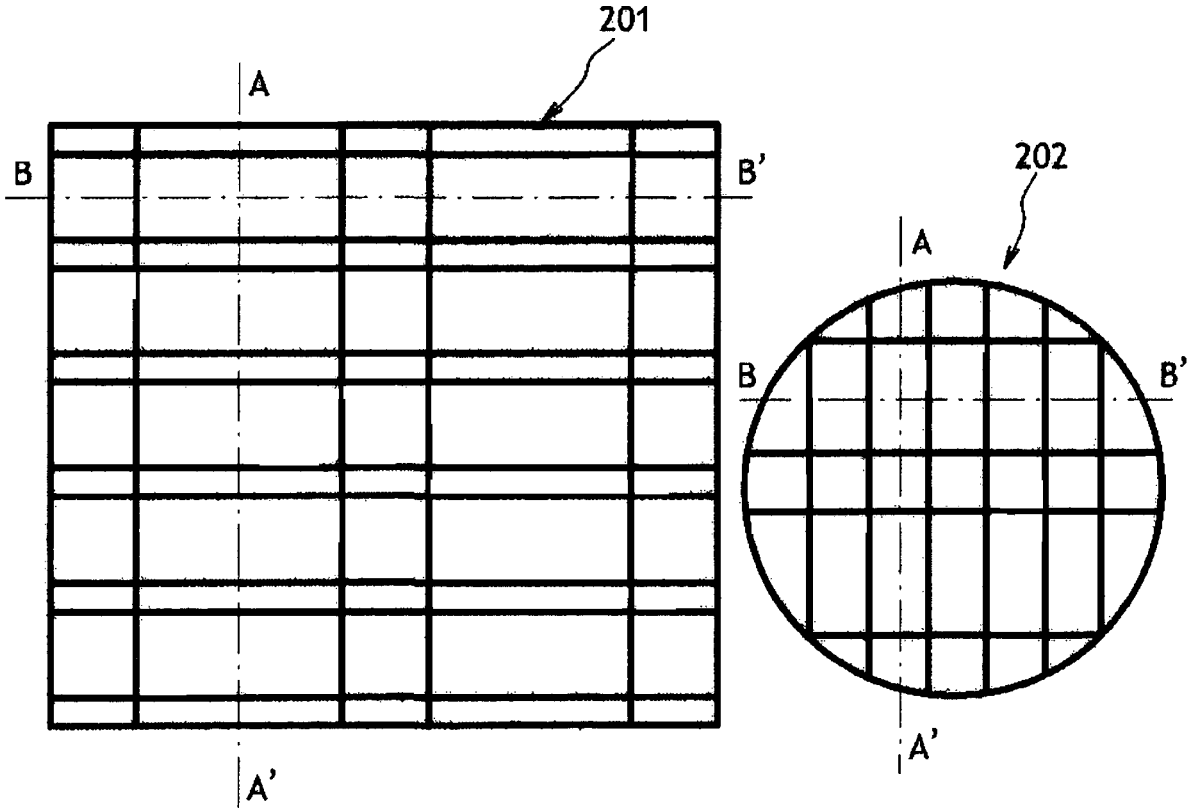
FIG. 11 is a top view of two 2-dimensional (2D) grids illustrating the further embodiments of the invention for an antiscattering grid.

The embodiments of the invention for an antiscattering grid illustrate a solution proposed on a 1D grid. However, the solution can also be used on a 2D grid comprising a plurality of crossing strips. As illustrated in FIG. 11, this 2D grid may be square 201 (or rectangular, etc.) or circular 202 (or ovoid, etc.) when viewed from above. In the case of a 2D antiscattering grid, the distances separating two successive strips can vary along two orthogonal A-A' and B-B' axes each crossing at least three successive strips (for a square 2D grid 201), or can vary along an A-A' axis and be constant along a B-B' axis orthogonal to the A-A' axis (case of the circular 2D grid 202).

In addition, while an embodiment of the invention has been described with reference to exemplary embodiments, it will be understood by those skilled in the art that various changes may be made in the way and/or structure and/or function and/or result and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. In addition, the order of the disclosed steps is exemplary. Furthermore, the use of the terms a, an, etc. do not denote a limitation of quantity, but rather denote the presence of at least one of the referenced item.

What is claimed is:

1. An antiscattering grid comprising:

a plurality of strips absorbing radiation distributed on the grid;

the distance separating two successive strips among the plurality of strips is not constant;

the strips extending transversely within the thickness of the grid;

the strips being separated from each other by and bonded to inter-strip members that are substantially transparent to the radiation; and three or more successive strips among the plurality of strips define a pattern that is repeated proceeding along an axis of the antiscattering grid, the axis oriented to cross the three or more successive strips.

2. The grid according to claim 1 wherein: three successive strips among the plurality of strips define the pattern that is repeated;

the first and second strips of the pattern being spaced a first distance; and the second and third strips of the pattern being spaced a second distance.

3. The grid according to claim 1 comprising:

five successive strips among the plurality of strips define the pattern that is repeated;

three successive strips of the pattern being spaced a first distance;

the other pairs of successive strips in the pattern being spaced a second distance.

4. The grid according to claim 1 comprising:

successive strips located in a central area of the grid are spaced a first distance; and the successive strips located in the peripheral areas of the grid are spaced a second distance.

5. The grid according to claim 1 comprising:

the strips among the plurality of strips are spaced at multiple distances.

6. The grid according to claim 5 comprising the multiple distances are distributed by increasing distance from the center of the grid to a periphery of the grid.

7. The grid according to claim 1 wherein the grid is a 1D grid.

8. The grid according to claim 1 wherein the grid is a 2D grid.

9. The grid according to claim 1 comprising the strips of the plurality of strips extend along a plurality of parallel planes.

10. The grid according to claim 1 comprising the strips of the plurality of strips extend in a plurality of planes, the planes of the plurality of planes intersecting along the same straight line.

11. The grid according to claim 1 wherein the distance separating two successive strips among the plurality of strips is a discrete number of pitches.

12. The grid according to claim 11 wherein the discrete number of pitches is different pitches distributed over the grid.

13. The grid according to claim 12 wherein the distribution is in distinct regions of the grid.

14. The grid according to claim 13 wherein:

smaller pitches being in the region of the grid closer to a central line; and higher pitches being present in a periphery of the grid.

15. The grid according to claim 1 wherein the distance separating two successive strips among the plurality of strips has two different pitches.

16. The grid according to claim 15 wherein the two different pitches are distributed over the grid.

17. The grid according to claim 16 wherein the distribution is in distinct regions of the grid.

18. The grid according to claim 17 wherein:

smaller pitches being in the region of the grid closer to a central line; and higher pitches being present in a periphery of the grid.

19. The grid according to claim 15 wherein the two different pitches are distributed alternately over the grid.

20. The grid according to claim 1 wherein the inter-strip members are made of a material comprising at least one of polymer and aluminum.

21. The grid according to claim 1 wherein:

a first and a second strip of the pattern being spaced a first distance;

at least two other successive strips of the three or more successive strips being spaced a second distance different from the first distance.

22. A radiation imaging apparatus comprising;

means for providing a source of emitted radiation;

means for providing an image receiver or a means for detecting the emitted radiation;

an antiscattering grid located between the means for providing a source of radiation and the means for providing an image receiver or a means for detecting;

the antiscattering grid comprising:

a plurality of strips absorbing radiation distributed on the grid;

the distance separating two successive strips among the plurality of strips is not constant;

the strips extending transversely within the thickness of the grid;

the strips being separated from each other by and bonded to inter-strip members that are substantially transparent to the radiation; and three or more successive strips among the plurality of strips define a pattern that is repeated proceeding along an axis of the antiscattering grid, the axis oriented to cross the three or more successive strips.

23. A method for manufacturing an antiscattering grid comprising:

forming an assembly of a plurality of strips of material substantially absorbing radiation and a substrate of flexible material substantially transparent to radiation;

folding the substrate assembly in an accordion fashion to obtain a stack of grid elements superposed on top of each other, the grid elements composed of the strips and inter-strip members, the inter-strip members defined by the folded substrate disposed between two consecutive strips; and fixing the elements thus superposed;

wherein the width of the inter-strip members forming the grid elements is not constant, three of more successive strips among the plurality of strips and define a repeating pattern that proceeds along an axis of the antiscattering grid, the axis oriented to cross the three or more successive strips of the plurality.

24. The method according to claim 23 wherein the superposing comprises:

defining the repeating pattern by:

disposing a first and a second strip on the substrate spaced a first distance; and disposing the second and a third strip on the substrate spaced a second distance different from the first distance.

25. The method according to claim 23 wherein the superposing comprises:

defining the repeating pattern by:

disposing three successive strips on the substrate spaced a first distance; and disposing two successive strips on the substrate spaced a second distance different from the first distance.

26. The method according to claim 23 wherein the forming an assembly comprises:

bonding strips of the plurality of strips alternately on one face of substrate and then on an opposing face thereof at varying distances.

* * * * *